US006453807B1

(12) United States Patent
Ramey

(10) Patent No.: US 6,453,807 B1
(45) Date of Patent: Sep. 24, 2002

(54) GOLF BALL MARKING TOOL

(76) Inventor: Shon C. Ramey, 5635 Bay Creek Dr., Lake Oswego, OR (US) 97035

( * ) Notice: Subject to any disclaimer, the term of this patent is extended or adjusted under 35 U.S.C. 154(b) by 0 days.

(21) Appl. No.: 09/819,129

(22) Filed: Mar. 27, 2001

(51) Int. Cl.[7] ..... B41F 17/00
(52) U.S. Cl. ..... 101/35; 101/4; 101/DIG. 40
(58) Field of Search ..... 101/35, 114, 119, 101/127, 128, 129, 4, DIG. 40; 73/65.02; 224/918; 473/285, 406

(56) References Cited

U.S. PATENT DOCUMENTS

| | | | | |
|---|---|---|---|---|
| 460,168 | A | 9/1891 | Van Houten | 33/21.2 |
| 676,506 | A | 6/1901 | Knight et al. | |
| 849,600 | A | 4/1907 | Cory | |
| 943,851 | A | 12/1909 | West | |
| 1,045,340 | A | 11/1912 | Supplee | |
| 1,096,084 | A | 5/1914 | West | |
| 1,139,689 | A | 5/1915 | Lyon | |
| 1,228,736 | A | 6/1917 | Bacheller et al. | |
| 1,286,205 | A | 12/1918 | Beaver | |
| 1,339,569 | A | 5/1920 | Lyon | |
| 1,390,926 | A | 9/1921 | Reach | |
| 1,476,203 | A | 12/1923 | Horne | |
| 1,527,691 | A | 2/1925 | McNab et al. | |
| 1,537,685 | A | 5/1925 | Ladd | |
| 1,641,562 | A | 9/1927 | Will et al. | |
| 1,814,170 | A | 7/1931 | Long | |
| 1,814,312 | A | 7/1931 | Heene | |
| 1,921,571 | A | 8/1933 | Jones | |
| 1,953,992 | A | 4/1934 | Seagers | |
| 1,963,494 | A | 6/1934 | Humphrey | |
| 1,999,647 | A | 4/1935 | Atti | |
| 3,019,762 | A | 2/1962 | Hautz | 101/35 |
| 3,161,041 | A | 12/1964 | Amburgey | 73/65 |
| 3,310,879 | A | 3/1967 | Brzezinski et al. | 33/501 |
| 3,325,168 | A | 6/1967 | Fyanes | 273/186 |
| 3,420,529 | A | 1/1969 | Goranson et al. | 273/187 |
| 3,512,262 | A | 5/1970 | Smyk et al. | 33/555 |
| 3,647,221 | A | 3/1972 | Holley | 273/235 |
| 3,753,565 | A | 8/1973 | Baker | 273/183 |
| 3,797,123 | A | 3/1974 | Fraley | 33/178 B |
| 3,828,442 | A | 8/1974 | Bernard | 33/178 B |
| 4,086,851 | A | 5/1978 | Brandell | 101/4 |
| 4,209,172 | A | 6/1980 | Yamamoto | 273/183 |
| 4,441,716 | A | 4/1984 | Chen | 273/183 |
| 4,546,644 | A | 10/1985 | Beny et al. | 73/65 |
| 4,803,922 | A | 2/1989 | Dennesen | 101/41 |
| 4,974,511 | A | 12/1990 | Hsi-Chou | 101/38.1 |
| 5,067,719 | A | 11/1991 | Mook | 273/213 |
| 5,401,019 | A | 3/1995 | Wissman et al. | 273/32 B |
| 5,450,791 | A | 9/1995 | Prohm | 101/333 |
| 5,564,707 | A | 10/1996 | Dinh | 473/218 |
| 5,632,205 | A | 5/1997 | Gordon et al. | 101/483 |
| 5,743,180 | A | 4/1998 | Arnke | 101/35 |
| 5,795,249 | A | 8/1998 | Johnson | 473/406 |
| 6,004,223 | A | 12/1999 | Newcomb | 473/257 |
| 6,120,394 | A | 9/2000 | Kametani | 473/378 |
| 6,213,012 | B1 * | 4/2001 | Arms | 101/35 |
| 6,324,971 | B1 * | 12/2001 | Urban | 101/35 |

OTHER PUBLICATIONS

"Line 'Er Up," Golf Magazine, p. 36, Jun. 2001.
Line a Putt Ball Alignment System, http://www.lineaputt.com, Web pp. 1–5, Jun. 8, 2001.
Line–M–Up advertisement, Maximum Golf, p. 55, Sep. 2000.

* cited by examiner

*Primary Examiner*—Andrew H. Hirshfeld
*Assistant Examiner*—Minh H. Chau
(74) *Attorney, Agent, or Firm*—Kolisch, Hartwell, Dickinson, McCormack & Heuser, PC

(57) ABSTRACT

A golf ball marking tool. The tool includes a receiving portion adapted to receive a portion of the golf ball, a gripping portion adapted to grip the golf ball, and a guide surface configured to define a marking position on the golf ball. The tool may also include an opening to facilitate disengagement of the ball from the gripping portion.

27 Claims, 2 Drawing Sheets

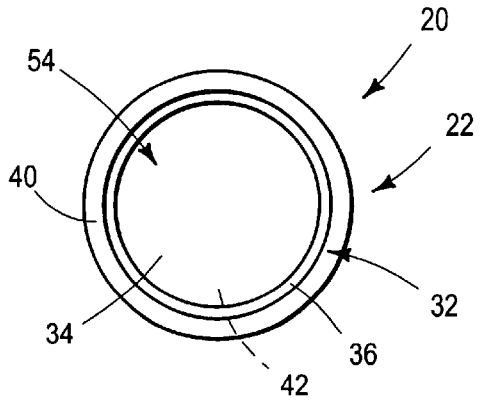
FIG. 7
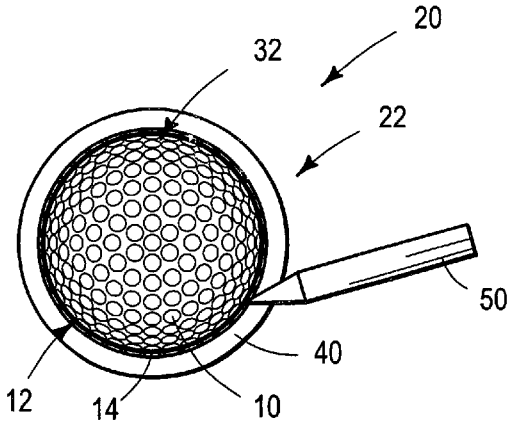
FIG. 8
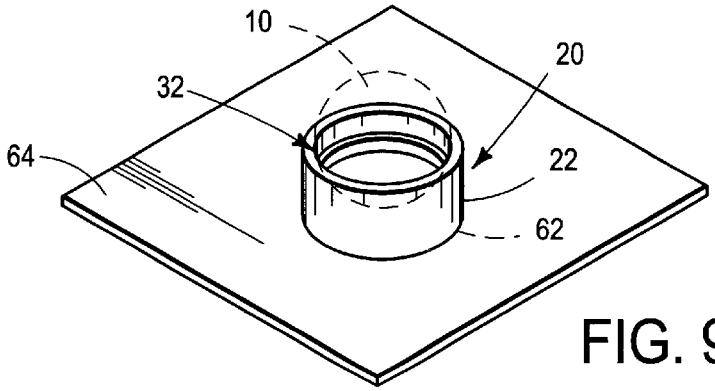
FIG. 9
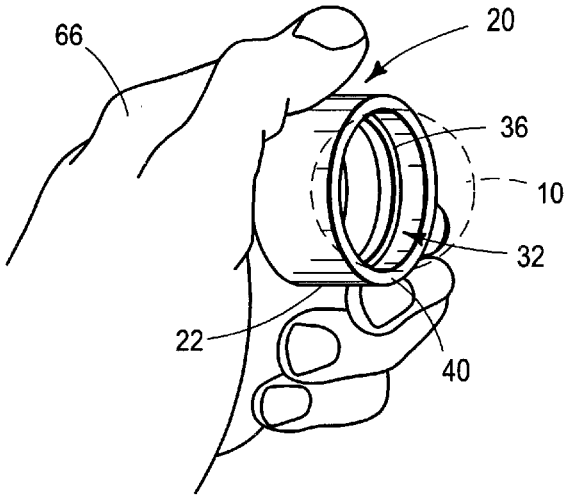
FIG. 10
FIG. 11
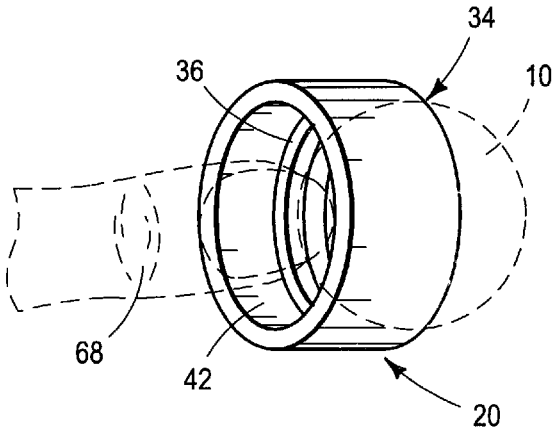

GOLF BALL MARKING TOOL

FIELD OF THE INVENTION

The present invention is directed to a golf ball marking tool, and more particularly, to a golf ball marking tool for marking alignment lines on a golf ball.

BACKGROUND

Golf is a popular activity. However, in a constant struggle to improve, golfers are continuously searching for new ways to increase their accuracy and consistency on the golf course. A wide assortment of training devices and aids are available for these frustrated players.

One example of such a training aid is a marked ball. A marked ball may be used for putting or for aligning a tee shot. Marks on the ball allow a golfer to sight down the line of the golf ball to more accurately aim the ball towards a target, such as a hole. Moreover, marks on the ball provide information on a golfer's technique.

Typically, golf balls are bought without alignment marks. One option is to use a ball that has pre-made marks on the ball. Alternatively, it would be convenient for a golfer to use the golfer's preferred brand and type of golf ball and mark it with an appropriate alignment line. However, it is difficult to make an unaided straight line on a curved, dimpled surface.

SUMMARY OF THE INVENTION

The present invention provides a golf ball marking tool for marking an alignment line on a golf ball. The marking tool includes a receiving portion adapted to receive a portion of the golf ball, a gripping portion configured to retain the golf ball in a predetermined orientation relative to the tool, and a guide surface adapted to define a marking position on the golf ball. The marking tool may also include a first opening adapted to receive a portion of the golf ball and a second opening adapted to facilitate removal of the golf ball from the tool.

BRIEF DESCRIPTION OF THE DRAWINGS

FIG. 7 is a top plan view of the marking tool of FIG. 2.

FIG. 8 is a top plan view of the marking tool of FIG. 2 being used to mark a golf ball.

FIG. 9 is a perspective view of another golf ball marking tool on a substantially planar surface constructed in accordance to the present invention.

FIG. 10 is a perspective view of the marking tool of FIG. 2 showing details of how the tool may be held by a user.

FIG. 11 is a perspective view of the marking tool of FIG. 2 showing details of a method for ejecting the golf ball from the tool.

DETAILED DESCRIPTION AND BEST MODE OF THE INVENTION

Figure 1:
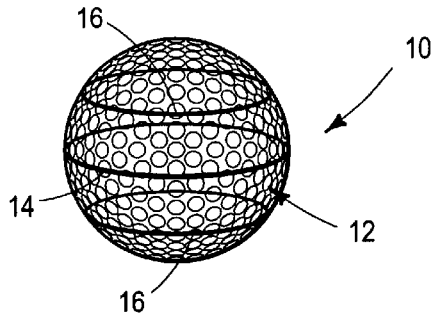
FIG. 1 is an isometric view of a golf ball marked in accordance with the present invention.

A golf ball marked using the marking tool described in this disclosure is shown generally at 10 in FIG. 1. It is difficult to make free hand straight lines on a dimpled golf ball. However, by using the disclosed marking tool, alignment lines 12 may be easily marked on ball 10.

Alignment lines 12 aid a golfer in aligning a tee shot or putt. Moreover, alignment lines 12 may also be used to identify the ownership of golf ball 10. By marking a great circle 14 or segments of a great circle on golf ball 10, a golfer may change an ordinary golf ball into a training aid. Great circle or equator line 14 is described by the intersection of the surface of a sphere with a plane passing through the center of the sphere. Additionally, small circles, which are circles that do not have a plane that intersects the center of the sphere, or segments of small circles may be marked. For example, as shown in FIG. 1, alignment lines have been marked on ball 10, including great circle 14 and two small circles 16. As shown, small circles 16 may be marked equidistant and parallel to great circle 14.

The disclosed marking tool used to mark alignment lines 12 is generally indicated at 20 in the figures. Tool 20, as depicted, is sized to fit into a user's hand. However, alternatively, tool 20 may be sized such that a portion of tool 20 fits into a user's hand.

Tool 20 is configured to hold a golf ball. Tool 20 includes a body 22 or holder, which includes an external handling surface 24 and an internal surface 26. External handling surface 24 is easily gripped by a user. For example, as shown in FIG. 2, illustrated embodiment 21 has an external surface 24 includes a wide band, which may be held in the palm of a user or by a user's fingers.

Figure 2:
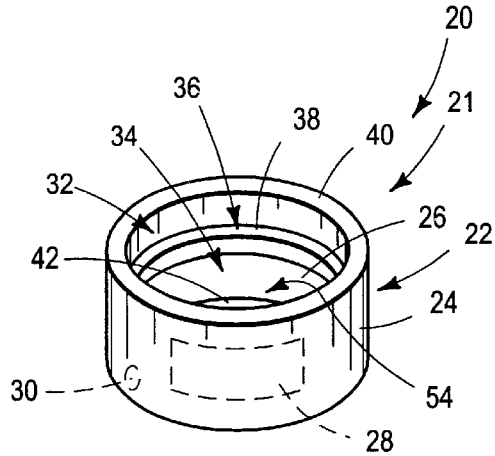
FIG. 2 is an isometric view of a golf ball marking tool used for marking a ball as shown in FIG. 1 and constructed in accordance to the present invention.
Figure 3:
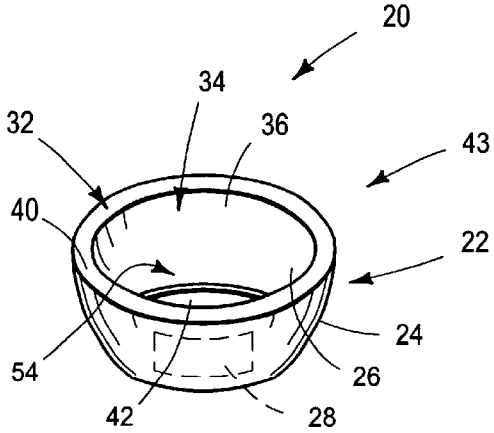
FIG. 3 is an isometric view of another golf ball marking tool constructed in accordance to the present invention.

External handling surface 24 may include an advertisement surface 28 for an advertisement, such as schematically illustrated in FIGS. 2 and 3. Advertisement surface 28 may extend around the wide band of external surface 24 or may form only a portion of external surface 24. Advertisement surface 28 may include a flat planar surface for advertisements. For example, as shown in FIG. 2, embodiment 21 has an external handling surface 24, which includes an advertisement surface 28 for an advertisement. The advertisement may be permanently or removably affixed to tool 20. For example, the advertisement may take the form of a preprinted sticker, which may be wrapped around the flat planar external surface of tool 20. Alternatively, the advertisement may be etched, printed, molded, or otherwise formed or mounted on tool 20.

Tool 20 is a portable device. Tool 20 is constructed such that it may be used on a golf course or at a practice range. For convenience and accessibility, tool 20 may include an attachment mechanism for attaching tool 20 to a golf bag, golf cart, or other golfing accessory. For example in FIG. 2, tool 20 may have an attachment mechanism, shown as a hole 30, which extends through tool 20. A rope or other suitable material may be received in hole 30 without detracting from the use of tool 20 and then tied to a golf bag or similar device. Alternatively and/or additionally, other attachment mechanisms may be used on tool 20 including, but not limited to clips, snaps, buckles, locks, magnets, or any other device adapted to couple tool 20 to clothing, golf bags or other golf accessories.

Tool 20 may be constructed of any weather-resistant durable material. For example, tool 20 may be constructed of one or more of plastic, rubber, metal, stiff cardboard, or any other suitable material. Additionally, tool 20 may be a single formed unit or may include a plurality of parts coupled together. Tool 20 may be formed by any suitable manufacturing process, such as molding, comolding and extrusion.

In the illustrated embodiments, body 22 of tool 20 is substantially ring-shaped having a receiving structure 32, which is also referred to as a receiving portion or ring structure. Receiving structure 32 is adapted to accommodate a portion of a golf ball. Receiving structure 32 has at least one opening 34 to receive a ball. For example, as shown in FIG. 2, body 22 includes a receiving structure or ring structure 32, which defines a ball receiving opening 34. Ball receiving opening 34 is shaped to receive at least a portion of a golf ball.

Ball receiving opening 34 is of sufficient size to receive a portion of a golf ball. For example, ball receiving opening 34 may be constructed such that substantially half of a golf ball is accommodated in the structure. Alternatively, ball receiving opening may be configured such that only a quarter or between one-quarter and one-half of the golf ball is accommodated inside receiving structure 32.

Lining the inside surface of receiving structure 32 is gripping structure 36. Gripping structure 36 is adapted to engage a golf ball in a selected orientation relative to tool 20. The gripping structure contacts the golf ball and releasably retains the ball within the receiving or ring structure 32. By applying slight pressure or an application force to a golf ball in receiving structure 32, the ball is pressed against gripping structure 36 and removably fixed in a stationary position relative to tool 20. The ball is held in a predetermined position relative to the ring structure 32. Gripping structure 36 deforms slightly or compresses the ball to restrain the ball within tool 20. Additionally, gripping structure 36 prevents the golf ball from rotating or spinning when a user marks the golf ball.

Gripping structure 36 is constructed such that it is associated with internal surface 26 of tool 20. For example, gripping structure 36 may be mounted on, integral with, or extend from internal surface 26. For example, in FIG. 2, gripping structure 36 includes a rib 38, which extends outward from internal surface 26. Rib 38 is an integral part of ring structure 36. The width of rib 38 is such that a golf ball is releasably held in a fixed position relative to ring structure 32. Alternatively, gripping structure 36 may be wider or constructed of a different material than that shown in FIG. 2. For example, gripping structure 36 may be a rubber ring or other suitable device that is mounted on or integral with internal surface 26.

Alternative configurations for gripping structure 36 may be used and are within the scope of the invention. For example in embodiment 21, rib 38 is configured to extend about the entire circumference of the golf ball. Alternatively, gripping structure 36 may be constructed such that it covers the entire surface of internal surface 26. Gripping structure 36 may also conform to the curvature of a golf ball. Moreover, gripping structure 36 may extend outward from surface 26 to contact the golf ball at spaced apart contact points. For example, gripping structure may include a plurality of spaced-apart teeth that engage the ball.

As described above, gripping portion or structure 36 extends outward from internal surface 26 to engage a golf ball. A slight elasticity or resilience allows the golf ball to be gripped by gripping structure 36, thereby preventing the immediate release of the golf ball. Hence, golf ball marking tool 20 and golf ball 10 are temporarily fixed together as a unit and are stable under normal line marking conditions. As described more in detail herein, gripping structure 36 self-retains ball 10 in a selected orientation relative to tool 20 without a user's assistance and without disturbance from a user marking the surface of ball 10. In effect, gripping structure 36 maintains ball 10 in a fixed position relative to tool 20 such that ball 10 does not require repositioning or additional contact during marking.

Tool 20 also includes a guide structure 40, which extends from body 22 of tool 20. Guide structure or surface 40 defines a marking path for marking alignment lines on a golf ball. As shown in FIG. 2, guide surface 40 is the edge adjacent the marking region of the ball defined by external surface 24 and internal surface 26. Alternatively, a configuration where guide surface 40 is spaced from ball 40 and still provides a traceable surface is within the scope of the invention.

When a golf ball is retained within tool 20, guide surface 40 is aligned with a marking region on the golf ball. Guide surface 40 is used to guide a marking implement along the outer surface of the golf ball along a predetermined position defined by the fraction of golf ball extending out from tool 20. Guide surface 40 may be a flat ledge or an inclined surface. By tracing guide surface 40, alignment marks or straight lines can be evenly made on the dimpled surface of a golf ball. For example, in FIG. 2, guide surface 40 is a ledge or rim, which permits a marking implement to trace a circle on a golf ball. Although shown as a flat ledge, an angled ledge which positions a marking implement at an angle to the golf ball may also be used and is within the scope of the invention.

Receiving portion 32 and/or gripping structure 36 define the position of the golf ball relative to guide surface 40. Guide surface 40 defines the marking position of each alignment mark on the golf ball. A user may follow the entire length of guide surface 40 to mark a complete circle on the golf ball without having to reposition the ball relative to tool 20. Alternatively, a user may follow only a portion of guide surface 40 to mark a straight-line segment or dot pattern on the golf ball.

A marking implement or instrument follows guide surface 40 such that an alignment mark can be made on the golf ball by a marking instrument. The marking instrument may be any size. For example, the marking implement may be a marker, pen, pencil, or other suitable writing device. The marking implement may be of any width since the guide surface is unobstructed on one side. This unobstructed edge permits a user to angle a writing device such as to make both narrow lines and wide bands on the golf ball. Moreover, depending on the angularity of the ledge, the marking instrument may be positioned parallel to the ledge or at an angle to the ledge depending on the marking instrument and the type of mark desired.

Tool 20 may include a second opening or ball removal opening 42 spaced away from ball receiving opening 34. Ball removal opening 42 may be sized to accommodate contact with the portion of golf ball contained within receiving structure 32. Ball removal opening 42 is configured to permit a user to apply a removing or contact force to the ball to push the ball out of tool 20 through ball receiving opening 34. The contact force unseats the ball from gripping structure 36 such that the ball may be separated from tool 20.

Ball removal opening 42 may have an area that is substantially identical to the area of ball receiving opening 34, or alternatively it may be larger or smaller than ball receiving opening 34. For example, ball removal opening 42 may be half or a quarter the size of ball receiving opening 34. In the illustrated embodiment shown in FIG. 3, ball receiving opening 34 and ball removal opening 42 define a ball receiving channel or passage 54 (also shown in FIGS. 6 and 7), which extends through the center of body 22.

Figure 4:
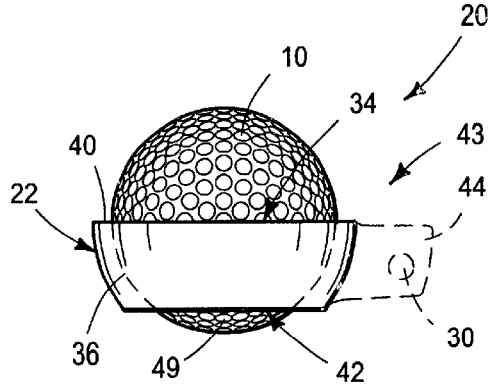
FIG. 4 is a side elevation view of the ball marking tool shown in FIG. 3.

FIGS. 3 and 4 disclose another illustrative embodiment of tool 20, which is generally indicated at 43. Unless otherwise indicated, embodiment 43 may have the same elements, sub-elements and variations as the other embodiments shown and described herein. For example, embodiment 43, like embodiment 21, includes body 22 having an external surface 24 and an internal surface 26. External surface 24 of embodiment 43 may follow the contours of a golf ball such that external surface 24 has a similar curved shape of a golf ball. Similar to embodiment 21, external surface 24 of embodiment 43 may include an advertisement surface 28, such as schematically illustrated in FIG. 3.

As described above, body 22 of tool 20 includes receiving structure 32, which includes ball receiving opening 34 adapted to receive a portion of a golf ball. In embodiment 43, the shape of internal surface 26 itself defines gripping structure 36. As shown in FIG. 4, gripping structure 36 is shaped such that a portion of the golf ball is snugly held within receiving structure 32. In embodiment 43, surface 26 may also be described as at least substantially conforming to the shape of the portion of ball 10 received therein. For example, as shown in FIG. 3, surface 26 may follow the contours of a golf ball. Gripping structure may also be textured (not shown) or coated with a liner to prevent a golf ball from slipping during marking. Alternatively, internal surface 26 may be shaped such that only a fraction of internal surface 26 defined gripping structure 36, such as ribs, teeth or protrusions that extend inward from surface 26.

Guide surface 40 of embodiment 43 extends along the upper portion of body 20. Guide surface 40 extends between the upper edge of external surface 24 and the upper edge of internal surface 26 that defines ball receiving opening 34. Guide surface 40, as described above, is configured to guide a marking implement along the exterior surface of the golf ball to produce an alignment line on the golf ball. The position of guide surface 40 relative to a golf ball is dependent on the fraction of the ball received by receiving structure 32 and held by gripping structure 36. Therefore, varying the size of the tool, such as the size of the ball receiving opening and gripping structure, enables different alignment lines to be defined by guide surface 40.

Additionally, embodiment 43 includes ball removal opening 42. Ball removal opening 42 may be spaced from ball receiving opening 34 such that a golf ball extends through ball removal opening 42. Alternatively, ball removal opening 42 may be sufficiently spaced from ball receiving opening 34 such that the ball does not extend into ball removal opening 42. Depicted embodiment 43 provides an illustrative example of an embodiment of tool 20 where golf ball 10 extends through ball receiving opening 34 with a fraction 49 of ball 10 projecting out of ball removal opening 42. A guide surface, for example 40, may be on either end of such an embodiment to permit a user to mark two different calibration lines. For example, in FIG. 4, a user could mark a great circle and a parallel small circle.

In FIG. 4, embodiment 43 is shown with a handle extension 44 illustrated in dashed lines. Handle extension 44 may extend from body 22 of tool 20. Additionally, handle extension 44 may be configured with hole 30 or other suitable fastener, such that tool 20 may be attached to a golf bag, cart, clothing, etc.

Figure 5:
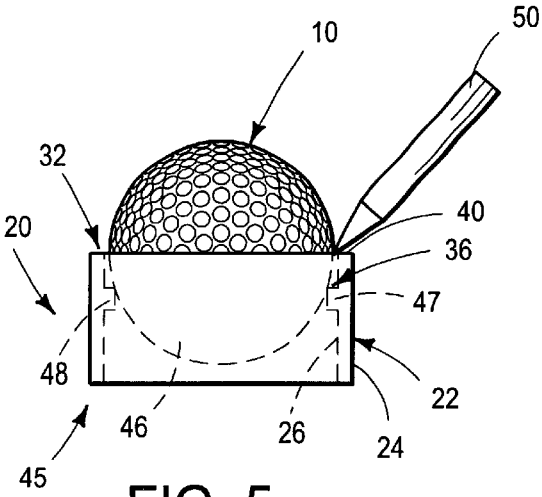
FIG. 5 is a front view of another golf ball marking tool constructed in accordance to the present invention.
Figure 6:
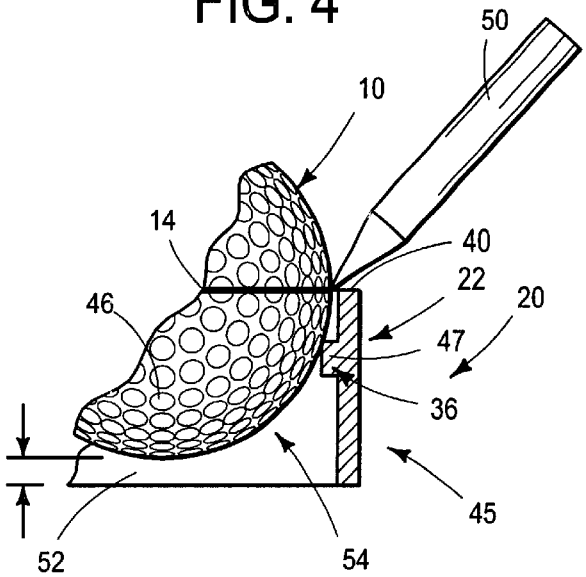
FIG. 6 is a cross-sectional view of the ball marking tool shown in FIG. 5.

FIGS. 5 and 6 disclose another illustrative embodiment of tool 20, which is generally indicated at 45. Unless otherwise indicated, embodiment 43 may have the same elements, sub-elements, and variations as the other embodiments shown and described herein. For example, embodiment 45 includes body 22 with an external gripping surface 24 and an internal surface 26. Similar to the other embodiments, body 22 of embodiment 45 includes a receiving portion 32, which is adapted to receive a portion of a golf ball. As shown, a portion 46 of ball 10 has been received in receiving portion 32 of tool 20.

Ball 10 is retained within receiving portion 32 by gripping portion 36. Embodiment 45 in FIG. 5 illustrates an example of an alternative configuration for gripping structure 36. As illustrated, embodiment 45 includes extensions or teeth 47 and 48 which project outward from internal surface 26 to restrain ball 10 within receiving portion 32. Teeth 47 and 48 may be attached to or integral with internal surface 26. Teeth 47 and 48 are constructed such that they compress against ball 10 to stabilize and restrain ball 10 within tool 20. Alternatively, tool 10 may include more than two extensions are contemplated and are within the scope of the invention. Typically, at least three or four projections are used to provide increased stability.

Gripping portion 36 aligns ball 10 such that a user may mark a great circle or a portion of a great circle on ball 10 by following a guide surface 40. As shown in FIGS. 5 and 6, gripping portion 36 may be configured such that guide surface 40 is slightly below the equator of ball 10 such that when a user marks ball 10 following guide surface 40 with a marking implement 50, a great circle 14 is marked which is approximately on the equator of the ball. Alternatively, gripping portion 36 may be positioned within receiving structure 32 such that guide surface 40 aligns with a different section of ball 10.

Similarly in FIG. 6, depicted embodiment 45 shows ball 10 in tool 20. When ball 10 is received in receiving portion 32, ball 10 extends downward into passage 54 of tool 20. A space 52, which forms a portion of passage 54, may be defined between the end of ball 10 and the bottom of tool 20. Depending on the position of gripping surface 36 and size of tool 20, space 52 may vary in size or may be non-existent. Moreover, the bottom of tool 20 may include either an opening 42 such as shown in embodiments 21 and 43 or a closed bottom.

FIGS. 7 and 8 are overhead views of tool 20 constructed according to the present invention. FIG. 7 shows an overhead view of tool 20 without ball 10 where body 22 is an annular structure. Guide surface 40 defines ball receiving opening 34. Gripping structure 36, as illustrated in embodiment 21 in FIG. 2, lines the inner surface of receiving portion 32 and is configured to contact and engage a golf ball. Ball receiving opening 34 and receiving portion 32 define a channel or passage 54, which extends through tool 20. The depth of channel 54 may vary. Tool 20 may include second opening or ball ejection opening 42.

FIG. 8 is an overhead view of tool 20 with golf ball 10 received in receiving portion 32 of the tool 20. Guide surface 40 extends outward from ball 10 such that marking implement 50 can be used to mark an alignment line 12 (shown in dashed lines in FIG. 8) on the dimpled surface of ball 10. For example, in FIG. 8, guide surface 40 is aligned such that a user would mark a great circle 14 on ball 10. A user may mark the entire circumference of the ball, 360 degrees, as shown, or alternatively, the user may mark only a portion of the circumference.

As illustrated in FIG. 8, great circle 14 is shown in dashed lines as would be marked by marking implement 50 as it follows guide surface 40. Depending on the position of gripping structure 36 and the amount of ball 10 received in receiving structure 32, small circles may also be made (as shown in FIG. 1). Moreover, a previously marked golf ball may be turned within tool 20 or otherwise repositioned so that additional alignment lines 12 may be made at different angles from each other. For example, ball 10 may be turned in tool 20 such that the ball is marked with intersecting great circles (not shown).

FIG. 9 shows another feature that may be present on some embodiments shown herein. In particular embodiments 21 (shown in FIG. 2) and 45 (shown in FIGS. 5 and 6) may include base 62. Base 62 is coupled to body 22. Base 62 is configured to rest on a substantially planar surface 64 as shown in FIG. 9. Base 62 allows ball 10 to project outward from surface 64 when in receiving portion 32. Ball 10 is held generally outwardly and upright relative to surface 64. Tool 20 may be configured such that ball 10 is resting on surface 64 when in receiving portion 32. Alternatively, as shown in FIG. 9, tool 10 may be constructed where ball 10 is spaced apart from surface 64.

Tool 20 may be configured to be held in one hand during use as shown in FIG. 10. A user may grip tool 20 in one hand 66 such that receiving portion 32 and gripping portion 36 of tool 20 retain ball 10 within tool 20. Ball 10 extends outward away from the palm of hand 66. Hence a user can hold body 22 of tool 20 without any need to grip ball 10. A user may use his/her second hand (not shown) to mark on the ball by following guide surface 40. Tool 20 is configured to prevent ball 10 from disengaging from tool 20 during use and also prevents ball 10 from slipping or repositioning during marking. Moreover, because user's hand 66 does not need to touch the ball, the access to guide surface 40 is unobstructed and the user does not need to readjust hand 66 to mark an alignment line on ball 10. Hence, a user may mark a continuous alignment line around the circumference of golf ball 10 in a single marking action. It should be understood that a user may contact the ball during marking, but this additional contact is not required.

Ball 10 may be ejected from tool 20 in a variety of ways. Since gripping portion 36 provides compression on ball 10, simply turning tool 20 over will not eject ball 10 from tool 20. However, in a number of embodiments, body 22, as described, has ball removal opening, which may also be referred to as ball ejection opening 42. This opening 42 facilitates removal of ball 10 from tool 20. For example, opening 42 may be sized to accommodate a portion of a hand of a user, such as digit 68, as shown in FIG. 11. Digit 68 may be a thumb, finger, or other body part that is able to contact and push ball 10 out of tool 20. By inserting digit 68 into ball ejection opening 42, ball 10 can be released from gripping structure 36 and pushed out ball receiving opening 34.

Alternatively, ball 10 may extend through second opening 42 as illustrated in embodiment 43 shown in FIGS. 3 and 4. For example, in embodiment 43 depicted in FIG. 4, ball 10 extends through second opening 42. A user may still eject ball 10 by pressing a digit against ball 10 such that ball 10 moves toward the ball receiving opening 34. Alternatively, ball 10 may be ejected from tool 20 by pushing tool 20 and therefore ball 10 into contact with a surface, such as planar surface 64 shown in FIG. 9. As tool 20 is compressed against a surface, the contact force against ball 10 will affect ball 10 such that it is released from gripping structure 36 and ejected from tool 20.

Second opening 42 may also be sized to accommodate other devices to apply the removing force to ball 10. For example, second opening 42 may be sized such that a user presses the head of a tee against ball 10. Alternatively, tool 20 may have a compressible membrane that extends across the second opening and is configured to be pressed against ball 10 to release the ball from tool 10.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and sub-combinations of the various elements, features, functions and/or properties disclosed herein. Where claims recite "a" or "a first" element or equivalent thereof, such claims should be understood to include incorporation of one or more such elements, neither requiring, nor excluding two or more such elements.

It is believed that the following claims particularly point out certain combinations and sub-combinations that are directed to one of the disclosed inventions and are novel and non-obvious. Inventions embodied in other combinations and sub-combinations of features, functions, elements and/or properties may be claimed through amendment of those claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A golf ball marking tool, comprising:

a body having a receiving portion adapted to receive a portion of a golf ball, wherein the receiving portion includes a ball-receiving opening and an internal surface of the body that defines a passage adapted to receive the portion of the golf ball that is inserted through the ball-receiving opening;

a gripping portion within the passage and spaced-apart from the ball-receiving opening, wherein the gripping portion extends from the internal surface, wherein the gripping portion is configured to engage the golf ball in a selected orientation and adapted to maintain the golf ball within the receiving portion; and a guide surface configured to define a marking path on the golf ball and adapted to align a marking implement along the path to mark a predetermined position on the golf ball.

2. The golf ball marking tool of claim 1, also comprising a base configured to support the tool on a substantially planar surface such that the ball extends outwardly from the surface.

3. The golf ball marking tool of claim 1, wherein the gripping portion is adapted to releasably couple the ball to the tool such that the ball and the tool are retained in defined positions relative to each other.

4. The golf ball marking tool of claim 1, wherein the predetermined position is an equatorial region of the golf ball.

5. The golf ball marking tool of claim 1, wherein the receiving portion includes a ring structure.

6. The golf ball marking tool of claim 1, wherein the tool includes an advertisement surface with an advertisement.

7. The golf ball marking tool of claim 1, wherein the guide surface is adapted to extend around a great circle of the golf ball.

8. The golf ball marking tool of claim 1, wherein the guide surface is adapted to extend around a small circle of the golf ball.

9. The golf ball marking tool of claim 1, wherein the guide surface includes an unobstructed edge that is sized to extend completely around the predetermined position of the golf ball.

10. The golf ball marking tool of claim 1, wherein the gripping portion is integral with the receiving portion.

11. The golf ball marking tool of claim 1, also comprising a ball removal opening adapted to facilitate removal of the ball from the gripping portion.

12. The golf ball marking tool of claim 1, wherein the gripping portion includes a plurality of radially spaced-apart teeth that project into the passage from the inner surface.

13. The golf ball marking tool of claim 1, wherein the gripping portion includes a rib that projects from the internal surface and extends radially inward into the passage from the internal surface, wherein the rib is spaced-apart from the ball-receiving opening and extends around at least a substantial portion of a circumference defined by the internal surface.

14. The golf ball marking tool of claim 1, wherein the receiving portion includes an edge that defines the ball-receiving opening, and further wherein the ball-receiving opening is sized such that a golf ball received into the passage and retained by the gripping portion is spaced-apart from the edge and the guide surface.

15. The golf ball marking tool of claim 1, wherein the passage is sized to at least substantially conform to the shape of the portion of a golf ball that is received in the passage and retained by the gripping portion.

16. The golf ball marking tool of claim 1, wherein the body includes a second opening that is spaced-apart from the ball-receiving opening and defines an outlet of the passage through which a portion of a golf ball that is received into the ball-receiving opening and retained by the gripping portion projects.

17. A marking tool for a golf ball, the marking tool comprising:

a receiving structure, having a first opening adapted to receive a portion of a golf ball and a second opening adapted to facilitate removal of the golf ball from the tool;

a gripping structure configured to engage and retain a portion of the golf ball that is inserted into the receiving structure, wherein the receiving structure is sized so that when a golf ball is inserted into the first opening and retained by the gripping structure, a fraction of the portion of the golf ball projects through the second opening such that the gripping structure is adapted to release the golf ball by engaging the fraction of the golf ball against a surface and urging the golf ball toward the first opening; and a guide structure configured to align a marking implement along a path to mark a predetermined position on the golf ball.

18. The marking tool of claim 17, wherein the gripping structure is adapted to releasably couple the ball to the tool such that the ball and the tool are retained in a defined position relative to each other.

19. The marking tool of claim 17, wherein the receiving structure includes a ring structure.

20. The marking tool of claim 19, wherein the first opening is adapted to receive substantially half of the golf ball.

21. The marking tool of claim 17, wherein the predetermined position is the equator of the golf ball.

22. The golf ball marking tool of claim 17, wherein the guide structure is adapted to define a circumference extending around the golf ball.

23. The golf ball marking tool of claim 22, wherein the receiving structure and the gripping structure are configured to receive and support a golf ball such that the guide structure is spaced-apart from the golf ball.

24. The marking tool of claim 17, wherein the receiving structure defines a ball-receiving passage with an internal surface extending between the first and the second openings, and further wherein the gripping structure is a portion of the internal surface that is spaced-apart from the first opening.

25. The marking tool of claim 17, wherein the receiving structure defines a ball-receiving passage with an internal surface extending between the first and the second openings, and further wherein the gripping structure is spaced-apart from the first opening and extends into the passage from the internal surface.

26. The marking tool of claim 25, wherein the gripping structure includes a plurality of radially spaced-apart teeth.

27. The marking tool of claim 26, wherein the gripping structure includes a rib that projects from the internal surface and extends radially inward into the passage from the internal surface, wherein the rib is spaced-apart from the ball-receiving opening and extends around at least a substantial portion of a circumference defined by the internal surface.

* * * * *

UNITED STATES PATENT AND TRADEMARK OFFICE

CERTIFICATE OF CORRECTION

PATENT NO. : 6,453,807 B1
DATED : September 24, 2002
INVENTOR(S) : Shon C. Ramey It is certified that error appears in the above-identified patent and that said Letters Patent is hereby corrected as shown below:

Column 10,
Line 16, after "20. The marking tool of claim" please delete "19" and insert -- 17 -- therefor.

Signed and Sealed this

Seventh Day of January, 2003

JAMES E. ROGAN
*Director of the United States Patent and Trademark Office*